United States Patent [19]

Yabsley et al.

[11] Patent Number: 4,936,933

[45] Date of Patent: Jun. 26, 1990

[54] PROCESS FOR PREPARING EXPLOSIVE

[75] Inventors: Michael Yabsley, Cheltenham; Flavio Xantidis, Broadmeadows, both of Australia

[73] Assignee: ICI Australia Operations Proprietary Limited, Melbourne, Australia

[21] Appl. No.: 278,779

[22] Filed: Dec. 2, 1988

[30] Foreign Application Priority Data

Dec. 2, 1987 [AU] Australia ..... PI5702

[51] Int. Cl.[5] ..... D03D 23/00

[52] U.S. Cl. ..... 149/109.6; 149/2; 149/46; 102/313

[58] Field of Search ..... 149/2, 109.6, 46; 102/313

[56] References Cited

U.S. PATENT DOCUMENTS 4,594,118 6/1986 Curtin et al. ..... 149/2

*Primary Examiner*—Stephen J. Lechert, Jr.

*Attorney, Agent, or Firm*—Cushman, Darby & Cushman

[57] ABSTRACT

A process for preparing a gas bubble sensitized explosive composition. The present process comprises preparing an explosive composition comprising a water-in-oil emulsion and mechanically entraining gas bubbles into the explosive composition. Low viscosity emulsion explosives are able to be sensitized by this process. There is a preference for wax free emulsions to be used. The process is applicable to emulsion explosives comprising ammonium nitrate particles. By providing a process for the mechanical entrainment of stable gas bubbles we allow explosive compositions to be sensitized on-site by readily available mixing means.

22 Claims, No Drawings

PROCESS FOR PREPARING EXPLOSIVE

This invention relates to a process for preparing a water-in-oil emulsion explosive comprising a dispersed gaseous phase.

Emulsion explosive compositions have been widely accepted in the explosives industry because of their excellent explosive properties and ease of handling. The emulsion explosive compositions now in common use in the industry were first disclosed by Bluhm in U.S. Pat. No. 3,447,978 and comprise as components: (a) a discontinuous aqueous phase comprising discrete droplets of an aqueous solution of inorganic oxygen-releasing salts; (b) a continuous water-immiscible organic phase throughout which the droplets are dispersed; (c) an emulsifier which forms an emulsion of the droplets of oxidizer salt solution throughout the continuous organic phase; and (d) a discontinuous gaseous phase.

Explosive compositions which comprise a blend of a water-in-oil emulsion explosive and a solid particulate ammonium nitrate (AN) such as ammonium nitrate prills, which may be coated with fuel oil (ANFO) have become popular because of their excellent performance and the reductions in cost due to the inclusion of a significant proportion, for example, 5 to 50% of AN (or ANFO)

Compositions comprising blends of a water-in-oil emulsion and AN (or ANFO) are described in Australian Patent Application No. 29408/71 (Butterworth) and U.S. Pat. Nos. 3,161,551 (Egly et al) 4,111,727 (Clay) 4,181,546 (Clay) and 4,357,184 (Binet et al).

The use of a gaseous phase to sensitise emulsion explosives and emulsion/AN (ANFO) blends is well known in the art. In preparing gas-sensitised products it is important to achieve an even distribution of gas bubbles of controlled size.

The methods currently used to incorporate a gaseous phase into blends include in situ gassing using chemical agents such as nitrite agents and the incorporation of closed cell, void material, commonly known as microballoons. Gassing by chemical means is highly temperature dependent and is often difficult to control accurately. Microballoons may be used to control accurately density however they are generally more expensive and difficult to use in the field.

Although mechanical mixing has been suggested as a method of incorporating a gas phase into emulsion explosives, its use in gassing blends has not achieved wide commercial acceptance due to the difficulty of achieving efficient dispersion of gas and the problem of poor gas phase stability as a result of coalescence and loss of gas bubbles.

Furthermore, prior art methods of gas entrainment by mechanical mixing have generally required the use of a substantial proportion of wax in the fuel phase making the emulsion less suitable for pouring and pumping at ambient temperature. For example U.S. Pat. No. 3,447,978 (Bluhm), and No. 4,149,917 (Wade) describe a water-in-oil emulsion explosive sensitised with occluded air. In order to entrain gas by mechanical method these patents teach that it is essential that the composition comprise at least 2% by weight of wax.

We have now developed a method of entraining gas bubbles to provide a stable gaseous phase in emulsion explosives, even in low viscosity emulsion explosives which are essentially wax free.

There is provided in accordance with the invention, a process for preparing a gas bubble sensitised explosive comprising preparing an explosive composition comprising a water-in-oil emulsion explosive and mechanically mixing said explosive in the presence of at least one gas bubble stabilising agent such that gas bubbles are entrained in the explosive composition.

It is preferred that said explosive composition comprise a mixture of a water-in-oil emulsion explosive and ammonium nitrate particles. Hence in a preferred embodiment the process of the invention comprises preparing an explosive composition by combining ammonium nitrate particles with a water-in-oil emulsion explosive and mechanically mixing the composition in the presence of a gas bubble-stabilizing agent such that gas bubbles are entrained in the composition.

Typically the composition will be mixed in the ratio of emulsion component to ammonium nitrate particles in the range of from 95:5 to 20:80, preferably 70:30 to 20:80.

The term ammonium nitrate particles refers to ammonium nitrate in the form of prills or prills coated with fuel oil (commonly known as "ANFO"), for example, ammonium nitrate particles coated with fuel oil in the range 2 to 15% w/w of prills.

The term water-in-oil emulsion explosive is well known in the art and refers to a composition comprising a discontinuous aqueous phase comprising at least one oxygen releasing salt, a continuous water-immiscible organic phase and a water-in-oil emulsifying agent.

It is particularly preferred that the emulsion explosive composition is essentially wax free.

A variety of mechanical mixing means may be used to entrain gas bubbles in accordance with the invention. Examples of mechanical mixing means include ribbon blenders, augers and axially rotatable drum blenders. A particularly preferred mechanical mixing means is the axially rotatable drum type blender, for example, the type commonly used in the mixing of concrete. An example of such a drum is disclosed in Australian Patent No. 557660. Augers also provide a preferred mixing means.

In the process of the present invention, the efficiency of gas bubble entrainment is determined by a number of inter-related parameters. The efficiency of gas-bubble entrainment is effected by the temperature of the explosive composition during mixing, the viscosity of the explosive composition during mixing, the nature of the water-immiscible organic phase and the nature of the gas bubble stabilizing agent.

The selection of the best method of performing the present invention will depend on local constraints such as climatic conditions and availability and cost of materials. The discussions hereinafter will allow the man skilled in the art to select the best method of performing the invention under the constraints imposed by local conditions without undue experimentation.

The temperature of the explosive composition during the mechanical mixing process is preferably in the range of from 0° to 70° C. and more preferably in the range of from 15° to 40° C. Typically it is convenient to entrain air blending at room (or ambient) temperature.

The viscosity of the explosive composition will be discussed in terms of apparent viscosity. Where used herein the term "apparent viscosity" refers to viscosity measure using a Brookfield RVT viscometer, #7 spindle at 50 r.p.m. It is preferred in the process of the present invention that the explosive composition of the water-in-oil emulsion explosive particles have an apparent viscosity greater than 10,000 cps prior to the entrainment of gas bubbles. Apparent viscosity is more preferably in the range 10,000 to 50,000 cps. A more preferred viscosity range for the entrainment of gas bubbles by mechanical mixing is from 10,000 to 35,000 cps. The range 10,000 to 25,000 cps provides the most efficient entrainment of gas bubbles by mechanical mixing.

The apparent viscosity is effected by the temperature of the explosive composition and by the make up of composition itself. In particular, the water-immiscible organic phase of the explosive composition has a substantial effect on the rheology of the explosive composition Examples of organic fuels for use in said water-immiscible organic phase are discussed hereinafter.

One further effect of temperature on the present process is in the efficiency of the gas bubble stabilizing agent. It may be necessary to increase the amount of gas-bubble stabilizing agent to accommodate an increase in processing temperatures.

Examples of gas bubble-stabilizing agents for use in the present invention include those described in Australian Patent Application No. 40959/85.

Preferably the gas bubble-stabilizing agent has properties which provide a suitable stabilizing effect which are established by means of a foam stabilization test as hereinafter described.

In the said foam stabilization test 0.2 part by weight of active ingredient of the candidate agent or mixture of agents to be tested is added to and mixed with 100 parts by weight of diesel fuel. 5 ml of the mixture is placed in a graduated cylindrical vessel of 15 mm internal diameter. The mixture is shaken for 15 seconds. A foam forms on the surface of the mixture. The volume ($V_5$) of the foam is measured 5 minutes after the mixture has ceased to be shaken using the graduations on the vessel. The foam volume ($V_{60}$) is measured again 60 minutes after the mixture has ceased to be shaken, the vessel and the mixture being kept at temperature of 18° to 22° C. during this period of time. A foam stability parameter $\phi^{60/5}$ is calculated from the foam volumes by means of the formula $$\phi^{60/5}=V_{609}/V_5$$

By way of illustration of the application of the foam stabilisation test, Table 1 records the results for a number of agents and mixtures of agents.

TABLE 1

| Foam Stabilisation | | Foam Properties | |
|---|---|---|---|
| Agent A | Agent B (if B is present the ratio w/w of A:B is 5:1) | $V^5$ (Volume expressed in $cm^3$) | $0^{60/5}$ |
| Fluorocarbons | | | |
| "Fluorad" FC 430 | | 5.2 | 1.0 |
| "Fluorad" FC 740 | | 4.6 | 0.76 |
| Simple acids & amines | | | |
| Stearic acid* | | 0 | 0 |
| Lauric acid* | | 0 | 0 |
| Octadecylamine* | | 0 | 0 |
| Sorbitan esters | | | |
| Sorbitan trioleate ("Span" 85)* | | 0 | 0 |
| Sorbitan monostearate ("Span" 60)* | | 0.5 | 1.0 |
| Sorbitan monopalmitate ("Span" 40)* | | 0.7 | 0.71 |
| Sorbitan alkoxylates | | | |
| Poly(oxyethylene)(20) Sorbitan monopalmitate ("Tween" 40)* | | 0 | 0 |
| Fatty alkoxylates | | | |
| Tallow amine ethylene oxide derivatives ("Teric") 17M2)* | | 0 | 0 |
| Poly(oxypropylene)(15) stearyl ether ("Arlamol" E)* | | 0 | 0 |
| Poly(oxyethylene)(2) Oleyl ether ("Brij" 93)* | | 0 | 0 |
| Miscellaneous | | | |
| Heptadecenyl oxazoline ("Alkaterge"T)* | | 0.5 | 0 |
| Phosphate ester of a non-ionic surface active agent ("Teric" 305)[c] | | 0 | 0 |
| "Fluorad" FC740 | "Fluorad" FC430 | 9.5 | 0.75 |
| "Fluorad" FC740 | "Fluorad" FC431 | 4.7 | 0.85 |
| "Fluorad" FC740 | "Span" 40 | 4.3 | 0.91 |

* = Agents not suitable for use in the present invention.

The designations "Fluorad", "Alkaterge", "Arlamol", "Brij", "Span", "Teric" and "Tween" are trade names.

It has been found that those agents or mixtures of agents in which the $V_5$ value was equal to or greater than 1 cubic centimeter and had a $\phi^{60/5}$ equal to or greater than 0.3 imparted the desired gas bubble stabilization effect. Hence the gas bubble stabilizing agents preferred for use according to the invention are those having a $V_5$ value equal to or greater than 1 cubic centimetre and a $\phi^{60/5}$ value equal to or greater than 0.3 as determined by the foam stabilization test hereinbefore described.

As referred to above, the agent which is capable of stabilizing gas bubbles sometimes comprises an organic moiety containing a hetero component, such as for example, an atom of nitrogen, silicon, sulfur or a halogen, in the gasophilic portion of the agent.

Preferably said agent comprises an organic moiety containing at least one hetero component in the gasophilic portion of the agent.

By gasophilic we mean that part of the agent which is capable of facilitating the production of gas bubbles in the composition. Thus certain gasophilic portions of the agent may be able to promote the formation of gas bubbles in the water-immiscible organic phase, whilst other gasophilic portions may be more suitable to form and maintain bubbles within a certain size range in the water-immiscible organic phase.

The gas bubble stabilizing agents used according to the process of the present invention may vary widely. Amongst the agents we have found that certain, non-ionic compounds selected from the halo alkyl esters are suitable, especially when the halo atom is fluorine. So as to facilitate the understanding of the nature of these halo alkyl esters they may, for the purposes of the invention, be considered to comprise three portions, a lipophilic portion which is joined to a joining portion which in turn is joined to a gasophilic portion.

The lipophilic portion is suitably a hydrocarbon the nature of which may vary widely. Thus the hydrocarbon may be in the form of a short or long carbon chain which may be straight or branched; other hydrocarbons may be in the form of rings for example aromatic or heterocyclic rings; yet again for example the hydrocarbon may comprise a polyether component derived from at least one alkylene oxide, for example, ethylene oxide, propylene oxide or butylene oxide.

The joining portion may vary widely and we have found that in suitable agents the joining group may comprise, for example, one or more of an amide, an amine, an ester, an ether or a sulphonamide.

The gasophilic portion may comprise, for example, straight or branched chains, aromatic compounds or derivatives of alkylene glycols. Thus for example, commercial non-ionic fluoroalkyl esters available from 3M Australia Pty Ltd of Melbourne Australia under the designations "Fluorad" FC430 and "Fluorad" FC 740 are believed to comprise an alkyl radical such as a perfluorinated carbon chain. As examples of other halo-bearing radicals in suitable agents, mention is made of gasophilic portions comprising radicals of the type $(CH_2)_x$—$(CF_2)_y$ or of the type $(CFH))_z$ wherein x, y & z are integers in the range, from as wide as 1 to 1000 or in a narrower range such as for example 1 to 20. Some agents may take the form of polymers and in this regard suitable gasophilic portions may be found in the so-called "comb" polymers which comprise pendant groups attached to a polymeric backbone.

Agents comprising suitable gasophilic portions for use according to our invention are typified by, but not limited to, the agents set out in Table 1. The proportion of the agents present in our compositions may be determined by simple experiment and will depend to some extent on the nature of the aqueous phase, the water-immiscible organic phase, the emulsifier and on the extent to which it is desired to produce gas bubbles in the compositions. Certain of the agents are highly efficacious in providing bubbles in accordance with our method and are useful when they are present in the compositions in a concentration as low as 0.0001% w/w. For other agents the concentration may need to be much higher, for example, up to 5% w/w, but in general it is not usually necessary to add more than 2% w/w of an agent to obtain a satisfactory product. It will be appreciated that for reasons of economy it is desirable to keep the concentration of the agent in a composition as low as possible commensurate with the effect which it is desired to obtain, and thus in many instances it is preferred that the agent constitutes from 0.0005 to 1.5% w/w of the composition and often lies within a range of from 0.001 to 1% w/w of the composition. Whilst it is usual to use a single agent it is permissible to use two or more agents, at least one of which should conform to the requirements of the foam stabilization test hereinbefore described, to form a mixed agent suitable for use in the invention. It has also been observed that such mixed agents sometimes exhibit synergism in that the capability of the mixed agent to facilitate the production of gas bubbles in a composition of the invention is greater than the sum of the capabilities of the individual agents.

Suitable oxygen-releasing salts for use in the aqueous phase component of the water-in-oil emulsion explosive component include the alkali and alkaline earth metal nitrates, chlorates and perchlorates, ammonium nitrate, ammonium chlorate, ammonium perchlorate and mixtures thereof. The preferred oxygen-releasing salts include ammonium nitrate. More preferably the oxygen-releasing salt comprises ammonium nitrate or a mixture of ammonium nitrate and sodium or calcium nitrates.

Typically, the oxygen-releasing salt component of the emulsion compositions comprises from 45 to 95% and preferably from 60 to 90% by weight of the water-in-oil emulsion component. In compositions wherein the oxygen-releasing salt comprises a mixture of ammonium nitrate and sodium nitrate, the preferred composition range for such a blend is from 5 to 80 parts of sodium nitrate for every 100 parts of ammonium nitrate. Therefore, preferably the oxygen-releasing salt component comprises from 45 to 90% by weight (of the total emulsion component) ammonium nitrate or mixtures of from 0 to 40% by weight (of the total composition) ammonium nitrate.

In the emulsion explosive component of the compositions preferably all of the oxygen-releasing salt is in aqueous solution. Typically, the amount of water employed in the compositions is in the range of from 1 to 30% by weight of the emulsion component. Preferably the amount employed is from 5 to 25%, and more preferably from 6 to 20%, by weight of the emulsion component.

The water-immiscible organic phase component of the emulsion composition comprises the continuous "oil" phase of the water-in-oil emulsion explosive and acts as a fuel. Suitable organic fuel include aliphatic, alicyclic and aromatic compounds and mixtures thereof which are in the liquid state at the formulation temperature. Suitable organic fuels may be chosen from fuel oil, diesel oil, distillate, kerosene, naphtha, paraffin oils, benzene, toluene, xylenes asphaltic materials, polymeric oils such as the low molecular weight polymers of olefins, animal oils, fish oils, and other mineral, hydrocarbon or fatty oils, and mixtures thereof. Preferred organic fuels are the liquid hydrocarbons generally referred to as petroleum distillates such as gasoline, kerosene, fuel oils and paraffin oils.

It is preferred that the water-immiscible organic phase is substantially wax free.

Typically, the water-immiscible organic phase of the emulsion explosive component comprises from 2 to 15% by weight and preferably 3 to 10% by weight of the emulsions component of the composition.

The emulsifying agent component of the composition of the emulsion phase may be chosen from the wide range of emulsifying agents known in the art to be suitable for the preparation of water-in-oil emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), conductivity modifiers, and mixtures thereof. Among the preferred emulsifying agents are the 2-alkyl- and 2-alkenyl-4,4'-bis(hydroxymethyl)oxazoline, the fatty acid esters of sorbitol, lecithin, copolymers of poly(oxyalkylene)glycols and poly(12-hydroxystearic acid), conductivity modifiers, and mixtures thereof, and particularly sorbitan mono-oleate, sorbitan sesquioleate, 2-oleyl-4,4'-bis(hydroxymethyl-)oxazoline, mixture of sorbitan sesquioleate, lecithin and a copolymer of poly(oxyalkylene) glycol and poly (12-hydroxystearic acid), conductivity modifiers, and mixtures thereof.

The most preferred emulsifying agents are the conductivity modifiers and mixtures comprising conductivity modifiers. Australian Patent Application No. 40006/85 (Cooper and Baker) discloses emulsion explosive compositions in which the emulsifier is a conductivity modifier. Included among such emulsifiers are condensation products of poly[alk(en)yl]succinic anhydride with amines such as ethylene diamine, diethylene triamine and ethanolamine.

Typically, the emulsifying agent component of the composition comprises up to 5% by weight of the emulsion composition. Higher proportions of the emulsifying agent may be used and may serve as a supplemental fuel for the composition but in general it is not necessary to add more than 5% by weight of emulsifying agent to achieve the desired effect. Stable emulsions can be formed using relatively low levels of emulsifying agent and for reasons of economy it is preferable to keep to amount of emulsifying agent used to the minimum required to have the desired effect. The preferred level of emulsifying agent used is in the range from 0.1 to 2.0% by weight of the emulsion composition.

If desired other, optional fuel materials, hereinafter referred to as secondary fuels, may be incorporated into the emulsions. Examples of such secondary fuels include finely divided solids, and water-miscible organic liquids which can be used to partially replace water as a solvent for the oxygen-releasing salts or to extend the aqueous solvent for the oxygen-releasing salts.

Examples of solid secondary fuels include finely divided materials such as: sulfur; aluminium; carbonaceous materials such as gilsonite, comminuted coke or charcoal, carbon black, resin acids such as abietic acid, sugars such as glucose or dextrose and other vegetable products such as starch, nut meal, grain meal and wood pulp; and mixtures thereof.

Examples of water-miscible organic liquids include alcohols such as methanol, glycols such as ethylene glycol, amides such as formamide and amines such as methylamine.

Typically, the optional secondary fuel component of the emulsion comprises from 0 to 30% by weight of the emulsion composition.

The water-in-oil emulsion component used in accordance with the invention may be prepared according to method known in the art. For example, the water-in-oil emulsion component may be prepared by:

dissolving said oxygen-releasing salt in water at a temperature above the fudge point of the salt solution, preferably at a temperature in the range of from 25° to 110° C. to give an aqueous salt solution; combining said aqueous phase and said water-in-oil emulsifying agent with said water-immiscible organic phase by rapid mixing to from a water-in-oil emulsion.

The gas-bubble stabilizing agent may be added at a convenient time during the preparation of the gas bubble-sensitized explosive. For example the gas bubble stabilizing agent may be added during the preparation of the emulsion component. Typically the gas-bubble stabilizing agent would be blended with the water-immiscible organic phase prior to the combination of the water-immiscible organic phase with the aqueous phase to form the water-in-oil emulsion.

Alternatively the water-in-oil emulsion may first be formed and the gas bubble stabilizing agent may be blended with the formed emulsion. Wherein ammonium nitrate particles are to be added to the emulsion it is possible to add said particles after the gas bubble stabilizing agent has been incorporated into the emulsion. However, it is preferred that the ammonium nitrate particles and the gas bubble stabilizing agent be blended simultaneously into the emulsion. It is particularly preferred that the gas bubble stabilizing agent be added after the ammonium nitrate particles have been blended into the emulsion.

It is advantageous to transport the emulsion, ammonium nitrate particles and the gas bubble stabilizing agent separately to the blast site. Depending on the conditions in a particular borehole, the composition of the gas bubble sensitized explosive may be varied by controlling the proportions of water-in-oil emulsion, ammonium nitrate particles and gas bubble stabilizing agent. The gas bubble sensitized explosive may be blended and aerated in a mobile mechanical mixing means and then loaded or pumped into the borehole.

The pumping process has a particularly deleterious effect on the firing characteristics of gas bubble sensitized explosives. The gas bubbles tend to coalesce during pumping which reduces the performance of the explosive when fired. The process of the present invention provides a gas bubble sensitized explosive which substantially maintains its density and firing characteristics after pumping.

The present invention therefore provides a method of loading a borehole with gas bubble sensitized explosive which method comprises preparing a gas bubble sensitized explosive as hereinabove defined and pumping said gas bubble sensitized explosive into the borehole wherein said gas bubble sensitized explosive substantially maintains its density and firing characteristics after pumping.

The invention is now demonstrated by but in no way limited to the following examples.

EXAMPLE 1 (E1)

(a) A water-in-oil emulsion explosive was prepared as follows:

The aqueous oxidizer phase was prepared by forming a solution of 7980 parts of ammonium nitrate, 50 parts of sodium acetate and 150 parts of acetic acid in 2000 parts of water at 70° C.

The oxidizer phase was added with rapid stirring to a mixture of 122 parts of a 1:1 molar condensate of polyisobutylene succinic anhydride (obtained from LUBRIZOL Corp and of nominal molecular weight 800 to 1200) and ethanolamine, 638 parts fuel oil and 7 parts of FLUORAD FC 740 (an agent available commercially from 3M Australia Pty Ltd which is believed to be a non-ionic fluoroalkyl ester). The emulsion was allowed to cool overnight.

(b) The water-in-oil emulsion explosive was placed in a small concrete mixer and blended with ammonium nitrate particles at a weight ratio of 7 parts emulsion to 3 parts ammonium nitrate particles. The viscosity of the blend was about 13,000 cps. Mixing was continued to provide a density of 1.13 $MgM^{-3}$. Samples of the resulting mixture were pumped into 90 mm and 130 mm cartridges and following pumping the density of the product was 1.21 $MgM^{-3}$.

Both cartridge types were detonated in an underwater test using a "K" primer containing 140 g of ANZOMEX primer.

EXAMPLE 2 (E2)

An emulsion explosive was prepared according to E1(a) except that the "FLUORAD" agent was omitted from the emulsion.

740 kg of the emulsion explosive was placed in a mobile rotary bowl type mixer of the type commonly used in mixing concrete (bowl capacity 5 $m^3$) and 0.55 kg of "FLUORAD" FC 740 agent was added and the mixture blended for 5 minutes at 12 rpm. The apparent viscosity of the emulsion mixture was found to be 15,000 cps. 240 kg of prilled ammonium nitrate was added and the mixture blended for a further 5 minutes. The density was found to be 1.24 $Mgm^{-3}$.

Two such batches were prepared and the explosive was pumped into fifty six blast holes through 20 metres of 25 mm diameter hose with approximately 35 kg per hole. Each charge was detonated using 140 g "ANZOMEX" primer.

COMPARATIVE EXAMPLE A (CEA)

27.6 kg of emulsion explosive was prepared according to E1(a) with the exception that the "FLUORAD" agent was omitted. The emulsion was loaded into a bowl type mixer of the type commonly used in mixing concrete and 11.8 kg of prilled ammonium was added and the mixture was blended at 12 rpm for 60 minutes. The density of the composition was measured after 15, 30 and 60 minutes of mixing and the results are shown in Table II below

TABLE II

| Time (min) | Density ($Mgm^{-3}$) |
|---|---|
| 15 | 1.35 |
| 30 | 1.34 |
| 60 | 1.36 |

EXAMPLE 3 (E3)

The product obtained from CEA had a density of 1.36 $Mgm^{-3}$ after mixing for 60 minutes. 11 g of "FLUORAD" FC 740 was added to the product of CEA and after a further 10 minutes of mixing the density of the product had reduced to 1.17 $Mgm^{-3}$ and was detonated in a 90 mm diameter cartridge using 140 g of ANZOMEX primer.

Emulsion Preparation A (EPA)

A water-in-oil emulsion was prepared as follows:

| Emulsion Composition | |
|---|---|
| Component | % (by weight of emulsion) |
| Ammonium Nitrate | 73.9 |
| Water | 18.5 |
| Emulsifier* | 1.2 |
| Fuel Oil | 6.4 |

*The emulsifier is a 1:1 molar condensate of polyisobutylene succinic anhydride and ethanolamine.

Ammonium nitrate was dissolved in water to form an oxidizer solution. The oxidizer solution, at 85° C., was stirred slowly into a blend of the emulsifier and fuel oil. The emulsion was refined with an air-stirrer with a 16 vaned $\phi$ 50 mm blade at 1600 rpm.

Procedure I (PI)

500 g of emulsion was equilibrated at a specified temperature (aeration temperature) in a jacketed bowl of a Hobart N50 planetary mixer. FLUORAO FC740 was blended with the emulsion. The emulsion was aerated with a whisk operated at speed setting 2.

EXAMPLE 4-6 (E4, E5, $E_6$)

Examples 4 to 6 demonstrate the effect of the amount of gas-bubble stabilizing agent on aerated emulsion density.

Emulsions were prepared according to EPA and an emulsion of apparent viscosity 14,000 cps and density 1.30 $Mgm^{-3}$ was formed. The so-formed emulsion was aerated according to PI at 52° C. for 5 minutes. The amount of gas-bubble stabilizing agent used is shown in Table III below.

TABLE III

| Example | Amount of FLUORAD FC740 (g/500 g of Emulsion) | Density after Aeration ($Mgm^{-3}$) |
|---|---|---|
| E4 | 0.2 | 1.26 |
| E5 | 0.4 | 1.19 |
| E6 | 0.6 | 1.09 |

EXAMPLE 7-10 (E7, E8, E9, E10 )

Examples 7 to 10 demonstrate the effect of aeration temperature on the emulsion density.

Emulsions were prepared according to EPA and emulsions of density 1.30 $Mgm^{-3}$ were formed. The so-formed emulsions were then aerated according to PI for 4 minutes. The aeration temperature is specified in Table IV, below.

TABLE IV

| Example | Aeration Temperature (°C.) | Apparent Viscosity Before Aeration (cps) | Apparent Viscosity After Aeration (cps) | Density After Aeration ($Mgm^{-3}$) |
|---|---|---|---|---|
| E7 | 23 | 18000 | 19000 | 1.19 |
| E8 | 31 | 18000 | 20000 | 1.22 |
| E9 | 47 | 18000 | 19000 | 1.25 |
| E10 | 51 | 18000 | 19000 | 1.25 |

EXAMPLE 11 AND 12 (E11, E12)

Example 11 and 12 demonstrate a further method of preparing a gas-bubble sensitized emulsion explosive.

| Emulsion Composition | |
|---|---|
| Component | % (by weight of emulsion) |
| Ammonium Nitrate | 73.841 |
| Water | 18.485 |
| Emulsifier | 1.199 |
| Fuel Oil | 6.395 |
| FLUORAD FC740 | 0.080 |

The emulsifier is a 1:1 molar condensate of polyisobutylene succinic anhydride and ethanolamine.

Ammonium nitrate was dissolved in water to form an oxidizer solution. The oxidizer solution at 85° C. was stirred slowly into a blend of the emulsifier, FLUORAD FC740 and fuel oil. The emulsion was refined with an air-stirrer with a 16 vaned $\phi$ 50 mm blade at 1600 rpm.

The so-formed emulsion had a density of 1.31 ($Mgm^{-3}$. 500 g of emulsion was aerated in a jacketed bowl of a Hobart N50 planetary mixer with a whisk operated at speed setting 2. The reduction in density is shown below in Table V.

TABLE V

| Example | Aeration Temperature (°C.) | Density after Aeration $Mgm^{-3}$ |
|---|---|---|
| E11 | 18 | 1.06 |
| E12 | 53 | 1.19 |

EXAMPLES 13-16 (E13, E14, E15, E16)

Examples 13 to 16 demonstrate the use of an altenative oil phase.

| Emulsion Composition | |
|---|---|
| Component | % (by weight of emulsion) |
| Ammonium Nitrate | 73.9 |
| Water | 18.5 |
| Emulsifier | 1.2 |
| Fuel Oil | 1.2 |
| Paraffin Oil | 5.2 |

The emulsion is a 1:1 molar condensate of polyisobutylene succinic anhydride and ethanolamine.

Ammonium nitrate was dissolved in water to form an oxidizer solution. The oxidizer solution, at 85° C., was stirred slowly into a blend of the emulsifier, fuel oil and paraffin oil. The emulsion was refined with an air-stirrer with a 16 vaned $\phi$ 50 mm blade at 1600 rpm.

500 g of emulsion was equilibrated at the temperature specified in table V below, in a jacketed bowl of a Hobart N50 planetary mixer. 0.19 g of FLUORAD FC740 was blended with the emulsion. The emulsion was aerated with a whisk operated at speed setting 2 for 4 minutes.

The emulsion density prior to aeration was 1.29 $Mgm^{-3}$.

Examples 13 to 16 exhibit a lower density after aeration than examples 7 to 10. The apparent viscosity of the emulsion increased significantly when compared to the increase in apparent viscosity observed in examples 7 to 10. We believe the increase in viscosity during aeration is due to the refinement of the emulsion.

TABLE VI

| Example | Aeration Temperature (°C.) | Apparent Viscosity (cps) Before Aeration | Apparent Viscosity (cps) After Aeration | Density After Aeration ($Mgm^{-3}$) |
|---|---|---|---|---|
| E13 | 21 | 24000 | 36000 | 1.22 |
| E14 | 31 | 19000 | 27000 | 1.17 |
| E15 | 46 | 20000 | 24000 | 1.19 |
| E16 | 51 | 20000 | 23000 | 1.21 |

EXAMPLES 17 19 (E17, E18, E19)

Examples 17 to 19 demonstrate a scaled-up process for the preparation of gas-bubble stabilized emulsion explosives and the inclusion of prilled ammonium nitrate.

41.6 kg of ammonium nitrate was dissolved in 10.4 kg of water to form an oxidizer solution. This oxidizer solution was heated to 85° C. and was added, with stirring, to a blend of 0.7 kg of 1:1 molar condensate of polyisobutylene succinic anhydride and ethanolamine, and 3.6 kg of fuel oil. The emulsion was refined to an apparent viscosity of 13200 cps at 65° C.

The emulsion was placed in a 75 kg capacity concrete-mixer, of the axially rotatable drum type. The emulsion was cooled to 55° C. then blended with 19.75 kg prilled ammonium nitrate and 45 g of FLUORAD FC740. When the explosive composition had cooled to 45° C. the apparent viscosity was found to be 20000 cps and the density 1.30 $Mgm^{-3}$. The explosive composition was mixed at 27 rpm for the following periods (see table VI) and the viscosity and density determined.

TABLE VII

| Example | Aeration Temperation (°C.) | Mixing Time (min) | Apparent Viscosity After Aeration (cps) | Density After Aeration ($Mgm^{-3}$) |
|---|---|---|---|---|
| E17 | 45 | 5 | 21000 | 1.25 |
| E18 | 44 | 10 | 21000 | 1.21 |
| E19 | 41 | 25 | 23000 | 1.21 |

Emulsion Preparation B (EPB)

A water-in-oil emulsion was prepared as follows:

| Emulsion Composition | |
|---|---|
| Component | % (by weight of emulsion) |
| Ammonium Nitrate | 73.9 |
| Water | 18.5 |
| Emulsifier* | 1.3 |
| Paraffin Oil | 6.3 |

*The emulsifier is a 1:1 molar condensate of polyisobutylene succinic anhydride and ethanolamine.

1478 g of ammonium nitrate was dissolved in 370 g of water to form an oxidizer solution. The oxidizer solution was added to 26 g of emulsifier blended with 126 g of paraffin oil in a jacketed bowl of a Hobart N50 planetary mixer. The emulsion was formed using a whisk at speed 2, then refined at speed 3.

EXAMPLES 20-22 (E20, E21, E22)

Examples 20 to 22 demonstrate the effect of the apparent viscosity of the emulsion.

Emulsions were prepared according to EPB and emulsions of density 1.31 $Mgm^{-3}$ were so formed. The emulsions were aerated according to PI at 53° C. 0.4 g of FLUORAD FC740 was added for each 500 g of emulsion. The emulsions were aerated for 5 minutes. TABLE VIII shows the results obtained.

TABLE VIII

| Example | Apparent Viscosity Before Aeration (cps) | Density After Aeration ($Mgm^{-3}$) |
|---|---|---|
| E20 | 18000 | 1.15 |
| E21 | 25000 | 1.20 |
| E22 | 32000 | 1.24 |

COMPARATIVE EXAMPLES B-D (CEB, CEC, CED)

Examples 20 to 22 (E20, E21, E22) were repeated except that the gas-bubble stabilizing agent was omitted from the formulation. The density of the emulsion The prior to aeration was 1.31 $Mgm^{-3}$. The results obtained are shown in table IX.

TABLE VIII

| Example | Apparent Viscosity Before Aeration (cps) | Density After Aeration ($Mgm^{-3}$) |
|---|---|---|
| CEB | 18000 | 1.30 |
| CEC | 25000 | 1.29 |
| CED | 32000 | 1.30 |

EXAMPLE 23 (E23)

Example 23 demonstrates a scaled-up process for the preparation of gas-bubble stabilized emulsion explosives and the inclusion of prilled ammonium nitrate.

41.6 kg of ammonium nitrate was dissolved in 10.4 kg of water to form an oxidizer solution. This oxidizer solution was heated to 85° C. and was added, with stirring, to a blend of 0.7 kg of 1:1 molar condensate of polyisobutylene succinic anhydride and ethanolamine, and 3.6 kg of paraffin oil. The emulsion was refined to an apparent viscosity fo 12800 cps at 74° C.

The emulsion was placed in a 75 kg capacity concrete-mixer, of the axially rotatable drum type. The emulsion was cooled to 55° C. then blended with 19.75 kg prilled ammonium nitrate and 45 g of FLUORAD FC740. When the explosive composition had cooled to 43° C. the apparent viscosity was found to be 29000 cps and the density 1.30 $Mgm^{-3}$. The explosive composition was mixed at 27 rpm and the viscosity and density determined (see table X).

TABLE X

| Example | Aeration Temperature (°C.) | Mixing Time (min) | Apparent Viscostiy After Aeration (cps) | Density After Aeration ($Mgm^{-3}$) |
|---|---|---|---|---|
| E23 | 40 | 10 | 27000 | 1.15 |

Emulsion Preparation C (EPC)

A water-in-oil emulsion was prepared as follows:

| Component | Emulsion Composition % (by weight of emulsion) |
|---|---|
| Ammonium Nitrate (chemically pure) | 73.92 |
| Water | 18.48 |
| Emulsifier* | 1.22 |
| Fuel Oil | 6.38 |

*The emulsifier is a 1:1 molar condensate of polyisobutylene succinic anhydride and ethanolamine.

Ammonium nitrate was dissolved in water to form an oxidizer solution. The oxidizer solution was combined with a blend of fuel oil and emulsifier to form a water-in-oil emulsion.

EXAMPLE 24

3570 kg of water-in-oil emulsion was prepared according to EPC. The apparent viscosity of the emulsion was 21000 cps. At 35° C., 1.7 kg of FLUORAD FC740 and 1190 kg of prilled ammonium nitrate was blended into the emulsion. The blend was then aerated in a mobile rotary bowl type mixer of the type commonly used in mixing concrete (bowl capacity 5 $m^3$) for 15 minutes at 10 rpm and for a further 15 minutes at 6 rpm. The density of the aerated blend was reduced to 1.24 $Mgm^{-3}$. The emulsion was pumped in a water lubricated (1.0–1.2% w/w of pumping rate) hose of internal diameter 25 mm at a rate of 100–125 kg/min under a pressure of 300–400 kPa. The density of the blend after being pumped for 50 m remained at 1.24 $Mgm^{-3}$.

EXAMPLE 25 (E25)

2740 kg of water-in-oil emulsion was prepared according to EPC. The apparent viscosity of the emulsion was 21000 cps. At 35° C. 2.1 kg of FLUORAD FC740 and 913 kg of prilled ammonium nitrate was blended into the emulsion. The blend was then aerated in a mobile rotary bowl type mixer of the type commonly used in mixing concrete (bowl capacity 5 $m^3$) for 15 minutes at 10 rpm and for a further 15 minutes at 6 rpm. The density of the aerated blend was reduced to 1.22 $Mgm^{-3}$. The emulsion was pumped in a water lubricated (1.0–1.2 % w/w of pumping rate) hose of internal diameter 25 mm at a rate of 100–125 kg/min under a pressure of 300–400 kPa. The density of the blend after being pumped 50 m (remained at 1.22 $Mgm^{-3}$.

EXAMPLES 26–29 (E26, E27, E28, $E_{29}$)

A water-in-oil emulsion was prepared according to EPC.

50 kg of emulsion of viscosity 21600 cps was placed in a 75 kg capacity concrete mixer, of the axially rotatable drum type. The temperature of the emulsion was 12° C. 20 kg of prilled ammonium nitrate and 20 g of FLUORAD FC740 was blended into the emulsion. The blend was aerated to a density of 1.15 $Mgm^{-3}$.

Unconfined firing tests were performed by charging cardboard tubes with the explosive composition, priming and firing.

TABLE XI

| Example | Diameter of charge (mm) | Primer | Velocity of Detonation (km/s) |
|---|---|---|---|
| E26 | 100 | ANZOMEX'D* | 4.5 |
| E27 | 75 | ANZOMEX'D | 4.1 |
| E28 | 75 | 50 g of Pentolite | 4.1 |
| E29 | 64 | ANZOMEX'D | 3.8 |

What is claimed is:

1. A process for preparing a gas bubble sensitised explosive comprising preparing an explosive composition comprising a water-in-oil emulsion explosive and mechanically mixing said explosive in the presence of at least one gas bubble stabilizing agent such that gas bubbles are entrained in the explosive composition, the apparent viscosity of the water-in-oil emulsion explosive prior to the entrainment of gas bubbles being in the range of 10,000 to 50,000 cps.

2. A process according to claim 1 wherein said apparent viscosity is in the range of 10,000 to 35,000 cps.

3. A process according to claim 2 wherein said apparent viscosity is in the range of 10,000 to 25,000 cps.

4. A process according to claim 1 wherein gas bubbles are entrained in the explosive composition by mechanically mixing said explosive composition wherein said mixing is provided by a mechanical mixing means selected from the group consisting of ribbon blenders, augers and axially rotatable drum blenders.

5. A process according to claim 4 wherein said mechanical mixing means is an axially rotatable drum blender.

6. A process according to claim 1 wherein gas bubbles are entrained in the explosive composition by mechanically mixing said explosive composition at a temperature in the range of 0° to 70° C.

7. A process according to claim 6 wherein said temperature is in the range of 15 to 40° C.

8. A process according to claim 6 wherein said temperature is ambient temperature.

9. A process according to claim 1 wherein the explosive composition comprises a mixture of water-in-oil emulsion explosive and ammonium nitrate particles.

10. A process according to claim 9 wherein the explosive composition comprises a mixture of water-in-oil emulsion explosive and ammonium nitrate particles present in the ratio of water-in-oil emulsion explosive to ammonium nitrate particles in the range of 95:5 to 20:80 by weight.

11. A process according to claim 10 wherein said ratio is in the range of 70:30 to 20:80 by weight.

12. A process according to claim 1 wherein the water-in-oil emulsion explosive comprises a discontinuous aqueous phase comprising at least one oxygen-releasing salt, a continuous water-immiscible organic phase and a water-in-oil emulsifying agent and wherein the water-immiscible organic phase of the water-in-oil emulsion explosive comprises an organic fuel selected from the group consisting of aliphatic, alicyclic and aromatic compounds and mixtures thereof which are in the liquid state at the temperature of emulsification.

13. A process according to claim 12 wherein said organic fuel is selected from the group consisting of fuel oil, diesel oil, distillate, kerosene, naphtha, paraffin oils, benzene, toluene xylene, asphaltic materials, polymeric oils and mixtures thereof.

14. A process according to claim 13 wherein said organic fuel is selected from the group consisting of gasoline, kerosene, fuel oils and paraffin oils.

15. A process according to claim 12 wherein said water-immiscible organic phase is present in the water-in-oil emulsion explosive in the range of 2 to 15% by weight of water-in-oil emulsion explosive.

16. A process according to claim 15 wherein said range is 3 to 10%.

17. A process according to claim 1 wherein the water-immiscible phase of the water-in-oil emulsion explosive is substantially wax free.

18. A process according to claim 1 wherein the gas bubble stabilizing agent, when subjected to a foam stabilization test, as hereinbefore defined, produces a foam which after standing for a period of five minutes has a volume ($V_5$) of not less than 1.0 $cm^3$ and after standing for a period of sixty minutes has a ratio ($\phi^{60/5}$) of foam volume after sixty minutes ($V_{60}$) to foam volume after 5 minutes of not less than 0.3.

19. A process according to claim 18 wherein said gas bubble stabilizing agent produces a $V_5$ value of greater than 4.0 $cm^3$ and $\phi^{60/5}$ ratio of greater than 0.5.

20. A process according to claim 1 wherein the gas bubble stabilizing agent is a non-ionic haloalkyl ester.

21. A process according to claim 20 wherein the gas bubble stabilizing agent is a non-ionic fluoroalkyl ester.

22. A method of loading a borehole comprising the steps of preparing a gas bubble sensitized explosive according to claim 1 and pumping said explosive into the borehole wherein said explosive substantially maintains its density and firing characteristics after pumping.

* * * * *